US009850564B2

(12) United States Patent
Kawakami et al.

(10) Patent No.: US 9,850,564 B2
(45) **Date of Patent: *Dec. 26, 2017**

(54) HIGH-STRENGTH α+β TITANIUM ALLOY HOT-ROLLED SHEET EXCELLENT IN COLD COIL HANDLING PROPERTY AND PROCESS FOR PRODUCING THE SAME

(75) Inventors: Akira Kawakami, Tokyo (JP); Hideki Fujii, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 595 days.

This patent is subject to a terminal disclaimer.

(21) Appl. No.: 14/001,395

(22) PCT Filed: Feb. 24, 2012

(86) PCT No.: PCT/JP2012/054630

§ 371 (c)(1),
(2), (4) Date: Aug. 23, 2013

(87) PCT Pub. No.: WO2012/115243

PCT Pub. Date: Aug. 30, 2012

(65) Prior Publication Data

US 2013/0327448 A1 Dec. 12, 2013

(30) Foreign Application Priority Data

Feb. 24, 2011 (JP) ..... 2011-038535

(51) Int. Cl.

| | |
|---|---|
| ***C22F 1/18*** | (2006.01) |
| ***C22C 14/00*** | (2006.01) |
| ***C22F 1/00*** | (2006.01) |

(52) U.S. Cl.

CPC ..... *C22F 1/183* (2013.01); *C22C 14/00* (2013.01); *C22F 1/00* (2013.01); *C22F 1/18* (2013.01)

(58) Field of Classification Search

CPC .... C22F 1/183; C22F 1/00; C22F 1/18; C22C 14/00

See application file for complete search history.

(56) References Cited

U.S. PATENT DOCUMENTS

2003/0196735 A1 10/2003 Sugiura et al.
2004/0221929 A1* 11/2004 Hebda ..... C22C 14/00 148/670

(Continued)

FOREIGN PATENT DOCUMENTS

CN 1462317 A 12/2003
CN 1814331 A 8/2006

(Continued)

OTHER PUBLICATIONS

Taiwanese Office Action, dated Jan. 21, 2014, for Taiwanese Application No. 101106352.

(Continued)

*Primary Examiner* — Jenny Wu

(74) *Attorney, Agent, or Firm* — Birch, Stewart, Kolasch & Birch, LLP

(57) ABSTRACT

A high-strength α+β type hot-rolled titanium alloy sheet containing 0.8 to 1.5 mass % Fe, 4.8 to 5.5 mass % Al, 0.030 mass % N, O and N, wherein cracks are prevented from spreading, wherein: (a) ND represents normal direction of a hot-rolled sheet; RD represents hot rolling direction; TD represents hot rolling width direction; θ represents the angle formed between c axis and ND; φ represents angle formed between plane including c axis and ND, and a plane including ND and TD; (b1) XND represents highest (0002) relative intensity of X-ray reflection by grains when θ is from 0° to 30° ; (b2) XTD represents the highest (0002) relative intensity of the X-ray reflection caused by grains when θ is from 80° to 100° and φ is ±10° . (c) The high-strength α+β

(Continued)

type hot-rolled titanium alloy sheet has a value for XTD/XND of at least 4.0. Q(%)=[O]+2.77·[N].

4 Claims, 4 Drawing Sheets

(56) References Cited

U.S. PATENT DOCUMENTS

| | | | | |
|---|---|---|---|---|
| 2006/0172819 | A1 | 8/2006 | Sano | |
| 2008/0011395 | A1* | 1/2008 | Matsumoto | C22C 14/00 148/670 |
| 2009/0180918 | A1 | 7/2009 | Tsai et al. | |
| 2009/0181794 | A1 | 7/2009 | Tsai et al. | |
| 2010/0074795 | A1 | 3/2010 | Takahashi et al. | |
| 2012/0234066 | A1* | 9/2012 | Takahashi | C22F 1/183 72/200 |

FOREIGN PATENT DOCUMENTS

| | | | | |
|---|---|---|---|---|
| CN | 101550505 | A | | 10/2009 | |
| CN | 101899690 | A | | 12/2010 | |
| EP | 1 163 969 | A1 | | 12/2001 | |
| EP | 1382695 | A1 | | 1/2004 | |
| EP | 0 963 109 | B1 | | 6/2004 | |
| EP | 2 508 643 | A1 | | 10/2012 | |
| JP | 59-215450 | A | | 12/1984 | |
| JP | 6144167 | A | | 3/1986 | |
| JP | 61-159562 | A | | 7/1986 | |
| JP | 02-034752 | A | | 2/1990 | |
| JP | 4-358036 | A | | 12/1992 | |
| JP | 07-062474 | A | | 3/1995 | |
| JP | 8-295969 | A | | 11/1996 | |
| JP | 09-228014 | A | | 9/1997 | |
| JP | 8-73968 | A | | 3/1998 | |
| JP | 10-94804 | A | | 4/1998 | |
| JP | 10-265876 | A | | 10/1998 | |
| JP | 2000-158141 | A | | 6/2000 | |
| JP | 2001-115222 | A | | 4/2001 | |
| JP | 2004-010963 | A | | 1/2004 | |
| JP | 2005-220388 | A | | 8/2005 | |
| JP | 2006-212092 | A | | 8/2006 | |
| JP | 2007-270199 | A | | 10/2007 | |
| JP | 2008-106317 | A | | 6/2008 | |
| JP | 2008-133531 | A | | 6/2008 | |
| JP | 2010-31314 | A | | 2/2010 | |
| JP | 4486530 | B2 | | 6/2010 | |
| JP | 4516440 | B2 | | 8/2010 | |
| JP | 4516640 | B2 | | 8/2010 | |
| JP | 2010255026 | A | * | 11/2010 | |
| JP | WO 2011068247 | A1 | * | 6/2011 | C22C 14/00 |
| JP | 4855555 | B2 | | 1/2012 | |
| JP | 2012-057200 | A | | 3/2012 | |
| TW | 200641148 | A | | 12/2006 | |
| TW | 1-293987 | B | | 3/2008 | |
| TW | 200838017 | A | | 10/2008 | |
| TW | 200932920 | A | | 8/2009 | |
| TW | 201033377 | A1 | | 9/2010 | |
| WO | WO 2011/068247 | A1 | | 6/2011 | |
| WO | WO 2012/115243 | A1 | | 8/2012 | |

OTHER PUBLICATIONS

PCT/ISA/210—International Search Report mailed on May 29, 2012, issued in PCT/JP2012/054630.
Final Office Action dated Aug. 4, 2016, issued in U.S. Appl. No. 14/366,239.
International Search Report issued in PCT/JP2012/082954, dated Feb. 5, 2013.
Non-Final Office Action dated Feb. 1, 2016, issued in U.S. Appl. No. 14/366,239.
Seishi Ishiyama, "Plastic Deformation and Press Formability of C.P. Titanium Sheet", The Japan Titanium Society, vol. 54, No. 1, pp. 42-51 (2006).
International Search Report issued in PCT/JP2012/054626, mailed on May 22, 2012.
Non-Final Office Action dated Jul. 5, 2016, issued in U.S. Appl. No. 14/380,386.
Takahashi et al., English Machine Translation of JP2005-220388, Aug. 2005, pp. 1-18.
Final Office Action dated Jul. 27, 2016 in U.S. Appl. No. 14/001,434.
International Search Report issued in PCT/JP2012/054625, dated May 29, 2012.
Non-Final Office Action dated Dec. 14, 2015, issued in U.S. Appl. No. 14/001,434.
Notice of Allowance for U.S. Appl. No. 14/001,434, dated Jan. 5, 2017.
Notice of Allowance for U.S. Appl. No. 14/366,239, dated Nov. 21, 2016.
Taiwanese Office Action dated Sep. 3, 2014 for Taiwanese Application No. 101106307.
Taiwanese Office Action for Taiwanese Application No. 101106307, dated Jan. 21, 2016.

* cited by examiner

HIGH-STRENGTH α+β TITANIUM ALLOY HOT-ROLLED SHEET EXCELLENT IN COLD COIL HANDLING PROPERTY AND PROCESS FOR PRODUCING THE SAME

TECHNICAL FIELD

The present invention relates to a high-strength α+β titanium alloy hot-rolled sheet, which is excellent in coil handling property, for example, such that a crack is less liable to be developed in the sheet width direction at the time of uncoiling and/or recoiling for such as cold leveling, and a process for producing the same.

BACKGROUND ART

Hitherto, an α+β titanium alloy has been used as an aircraft member by utilizing its high specific strength. In recent years, the weight ratio of a titanium alloy to be used in aircraft members is increasing, and this alloy may become more and more important. In addition, for example, also in the consumer products field, an α+β titanium alloy which is characterized by high Young's modulus and light specific gravity thereof, may be often used for the application to a golf club face, etc.

Further, the high-strength α+β titanium alloy may be expected to find its future application in an automotive component wherein a reduction in the weight thereof is important, in a geothermal well casing requiring corrosion resistance and specific strength, and the like. In particular, the titanium alloy may be used in the form of a sheet in many cases, and therefore, the needs for high-strength α+β titanium alloy sheet may be high.

As the α+β titanium alloy, Ti-6% Al-4% V alloy (herein, "%" is mass %, in the same manner hereinafter) may be most widely used and a representative alloy, but it has poor hot workability. When the α+β titanium alloy is subjected to hot rolling, edge cracking, that is, cracking along the sheet width direction, may be generated in both edge parts of the resultant hot-rolled sheet.

When a hot-rolled coil with edge cracking remaining is intended to be cold recoiled or uncoiled for such as tension leveling or the like, there may be a posed problem such that a crack may propagate in the sheet width direction starting from the edge cracking, to thereby cause a sheet fracture (or a fracture through the width direction of the sheet) in some cases. In other words, the α+β titanium alloy may have a drawback that cold coil handling property thereof is poor.

When the sheet fracture occurs, the fractured sheet must be removed from the production line, and the production may be inhibited because of the reason, for example, that the removal thereof takes time. Accordingly, the production efficiency may be reduced and at the same time, a safety problem may arise, for example, such that the sheet itself or a piece of the fractured sheet may come to fly suddenly due to the impact upon the fracturing.

Further, the sheet may significantly be deformed near a portion where the fracture has occurred in the sheet, and the portion cannot be used as a product in many cases. As a result, the production yield may be dropped, and the coil may be reduced in the unit mass, so as to further decrease the production efficiency and yield.

In this case, it may be a most effective solution that the coil is trimmed in a slitting step so as to remove the edge cracking generated in the hot-rolled coil, and then subjected to a cold leveling step. However, when the tension that works on the sheet during cold leveling is fluctuated due to plugging with trimming scraps during the trimming, sheet fracture may occur. Also, when the edge cracking is deep, the reduction in the production yield due to the trimming may be high, so as to cause an increase in the production cost.

For these reasons, there has been demanded, mainly, an α+β titanium alloy hot-rolled sheet such that it has a superior handling property, ensures that a crack initiating from edge cracking may hardly be propagated in the width direction of the sheet, and also is excellent in cold recoiling and/or uncoiling property, and it can produce a cold rolled strip. To meet this demand, several α+β titanium hot-rolled alloys capable of producing a cold-rolled strip have been proposed.

Patent Documents 1 and 2 propose an α+β titanium hot-rolled alloy of low-alloy system containing Fe, O and N as main alloying elements. This titanium hot-rolled alloy may be an alloy where Fe is added as a β stabilizing element and inexpensive elements, O and N, are added as α stabilizing elements in proper ranges at a proper balance, so as to achieve a high strength-ductility balance. In addition, the titanium hot-rolled alloy mentioned above has a high ductility at room temperature and therefore, it may also be an alloy capable of producing a cold-rolled product.

Patent Document 3 discloses a technique where Al capable of contributing to the achievement of high strength but of decreasing ductility so as to reduce the cold workability is added, and, on the other hand, Si or C which is effective in increasing the strength, but does not deteriorate the cold rollability is added, to thereby enable the cold rolling. Each of Patent Documents 4 to 8 discloses a technique for enhancing mechanical characteristics by adding Fe and O and controlling the crystal orientation, crystal grain size or the like.

Patent Document 9 discloses a technique where in pure titanium, the grain is refined and hot rolling is started in β single phase region so as to prevent the generation of wrinkles or scratches. Patent Document 10 discloses an α+β casting titanium alloy of Ti—Fe—Al—O system for a golf club head. Patent Document 11 discloses an α+β titanium alloy of Ti—Fe—Al system.

Patent Document 12 discloses a titanium alloy for a golf club head, where the Young's modulus is controlled by a final finish heat treatment. Non-Patent Document 1 discloses a technique for forming a texture in pure titanium through heating to β region and subsequent uni-directional rolling in the α region.

However, these techniques are not to enable cold coil handling property of a hot-rolled sheet by controlling the structure of an α+β titanium alloy hot-rolled sheet to thereby enhance the toughness of the hot-rolled sheet.

PRIOR ART DOCUMENTS

Patent Documents

Patent Document 1: Japanese Patent No. 3,426,605
Patent Document 2: JP-A (Japanese Unexamined Patent Publication; Kokai) No. 10-265876
Patent Document 3: JP-A No. 2000-204425
Patent Document 4: JP-A No. 2008-127633
Patent Document 5: JP-A No. 2010-121186
Patent Document 6: JP-A No. 2010-31314
Patent Document 7: JP-A No. 2009-179822
Patent Document 8: JP-A No. 2008-240026
Patent Document 9: JP-A No. 61-159562

Patent Document 10: JP-A No. 2010-7166
Patent Document 11: JP-A No. 07-62474
Patent Document 12: JP-A No. 2005-220388

Non-Patent Document

Non-Patent Document 1: *Titanium,* Vol. 54, No. 1, pp. 42-51 (The Japan Titanium Society, issued on Apr. 28, 2006)

SUMMARY OF THE INVENTION

Problem to be Solved by the Invention

Under these circumstances, a problem to be solved by the present invention is to keep an α+β titanium alloy hot-rolled sheet from the occurrence of sheet fracture due to a crack in the TD (or transverse direction) of the hot-rolled sheet, which may be generated in a sheet edge part and is developed straight in the sheet width direction, which corresponds to TD, upon cold uncoiling the hot-rolled sheet coil for leveling or the like. An object of the present invention is to provide a high-strength α+β titanium alloy hot-rolled sheet, which is capable of solving the above problem, and a process for producing the same.

Means to Solving the Problem

In order to solve the above problem, the present inventors have taken note of the texture capable of greatly affecting the toughness and made intensive studies on the relationship between the development of a crack initiating from edge cracking or the like, and the hot-rolling texture in an α+β titanium alloy hot-rolled sheet. As a result, the present inventors have made the following discovery.

(x) When the crystal structure has a hot-rolling texture (a texture called "Transverse-texture"; hereinafter, referred to as "T-texture") in which the normal direction of a hexagonal basal plane ((0001) plane), that is, the c-axis orientation, of a titanium α phase of a hexagonal close-packed structure is strongly oriented in the TD (width direction of the hot rolled sheet), the crack propagation propensity in the TD can be suppressed and the sheet fracture is less liable to occur.

(y) When the T-texture is strengthened, the strength in the hot rolling direction (hereinafter, referred to as "RD") may be reduced and the ductility and flexural characteristics may be enhanced, to thereby further facilitate cold uncoiling of the hot-rolled sheet coil.

(z) The T-texture can be formed while maintaining the strength by adjusting the contents of inexpensive elements Fe and Al, and the contents of O and N.

These discoveries will be described in detail hereinafter.

The present invention has been accomplished on the basis of the above discovery, and the gist of the present invention resides in the followings.

[1] A high-strength α+β titanium alloy hot-rolled sheet excellent in cold coil handling property, which is a high-strength α+β titanium alloy hot-rolled sheet, comprising, in mass %, Fe: 0.8 to 1.5%, Al: 4.8 to 5.5%, and N: 0.030% or less, and, containing O and N to satisfy the condition that Q (%) defined by the following formula (1) is 0.14 to 0.38, with the balance being Ti and unavoidable impurities, wherein, (a) the normal direction of a hot-rolled sheet is taken as ND, the hot rolling direction is taken as RD, the hot-rolling width direction is taken as TD, the normal direction of the α-phase (0001) plane is taken as c-axis orientation, the angle formed between the c-axis orientation and the ND is taken as θ, and the angle formed between a plane including the c-axis orientation and the ND, and a plane including the ND and the TD is taken as φ;

(b1) among (0002) relative reflection intensities of X-ray by a grain where θ is from 0 to 30° and φ falls in the entire circumference (from −180 to 180°), the highest intensity is taken as XND;

(b2) among (0002) relative reflection intensities of X-ray caused by a crystal grain where θ is from 8.0 to less than 100° and φ falls in ±10°, the highest intensity is taken as XTD; and (c) XTD/XND is 4.0 or more:

$$Q(\%)=[O]+2.77\cdot[N] \quad (1)$$

wherein [O]: the content (mass %) of O, and [N]: the content (mass %) of N.

[2] The high-strength α+β titanium alloy hot-rolled sheet excellent in cold coil handling property according to [1], wherein (d) the Vickers hardness of a cross-section perpendicular to the RD of the hot-rolled sheet is H1, and the Vickers hardness of a cross-section perpendicular to the TD H2, the hardness anisotropy index represented by (H2−H1)·H2 is 15,000 or more, and (e) in a Charpy test piece sampled from the hot-rolled sheet, where the RD is the test piece longitudinal direction and a notch with a depth of 2 mm is formed in the TD, the length of a perpendicular line drawn down vertically from the notch bottom to the opposing surface is "a" and the length of a crack actually propagated after the test is "b", the fracture inclination index represented by "b/a" is 1.20 or more.

[3]A process for producing a high-strength α+β titanium alloy hot-rolled sheet excellent in cold coil handling property, wherein in a process for producing the high-strength α+β titanium alloy hot-rolled sheet excellent in cold coil handling property according to [1] or [2], at the time of hot-rolling an α+β titanium alloy, the titanium alloy prior to the hot rolling is heated to a temperature ranging β transformation temperature to (β transformation point +150° C.) and hot-rolled uni-directionally by setting the hot rolling finishing temperature to be (β transformation temperature −250° C.) to (β transformation temperature −50° C.) and the sheet thickness reduction ratio defined by the following formula to be 90% or more;

Sheet thickness reduction ratio (%)={(sheet thickness prior to hot rolling−sheet thickness after hot rolling)/(sheet thickness prior to hot rolling)}·100

EFFECT OF THE INVENTION

The present invention can provide a high-strength α+β titanium alloy hot-rolled sheet, which is capable of ensuring that the sheet fracture due to a crack initiating from edge cracking or the like and propagating in the TD is less liable to occur, and the hot-rolled sheet has high ductility and bendability in the RD so as to facilitate the uncoiling thereof.

BRIEF DESCRIPTION OF THE DRAWINGS

FIG. 1(*a*) is a view showing a crystal grain (hatching part) where θ formed between the c-axis orientation and the ND is from 0 to 30°, and φ falls in the entirety of circumference (from −180 to 180°).

FIG. 1(*c*) is a view showing a crystal grain (hatching part) where θ formed between the c-axis orientation and the ND is from 80 to 100° and φ falls in ±10°.

MODES FOR CARRYING OUT THE INVENTION

As described above, the present inventors have made intensive studies on the relationships between the development of a crack initiating from edge cracking or the like, and the hot-rolling texture in an α+β titanium alloy hot-rolled sheet. Hereinbelow, the results thereof will be described in detail.

Figure 1A:
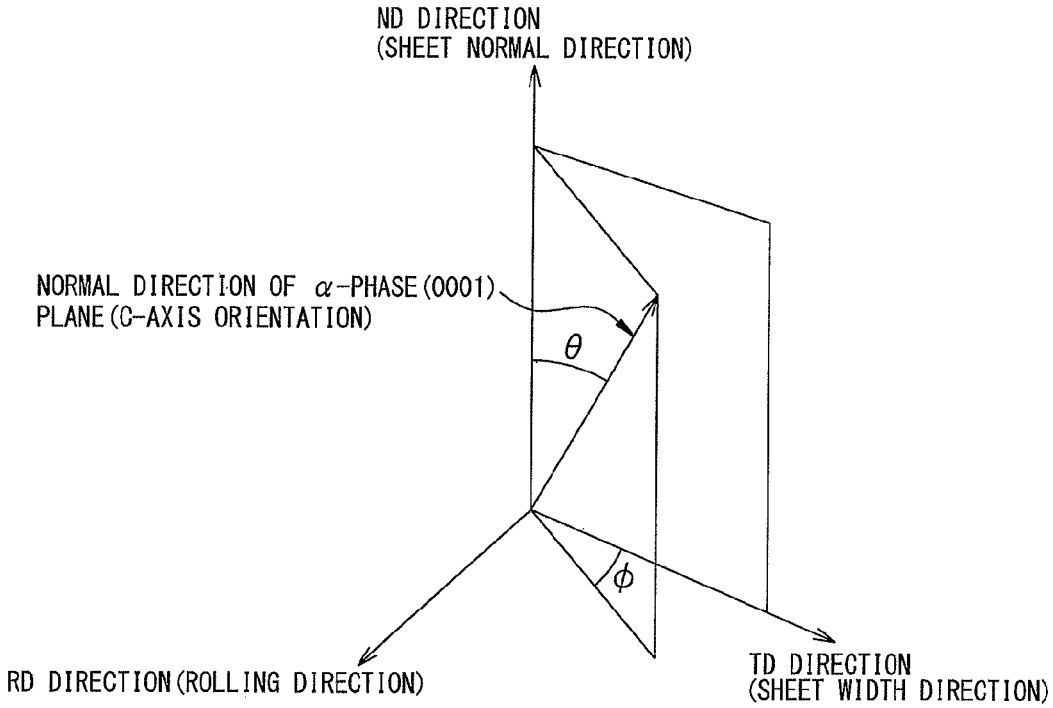
FIG. 1(*a*) is a view showing a relative directional relationship between crystal orientation and the surface of a sheet.
Figure 1B:
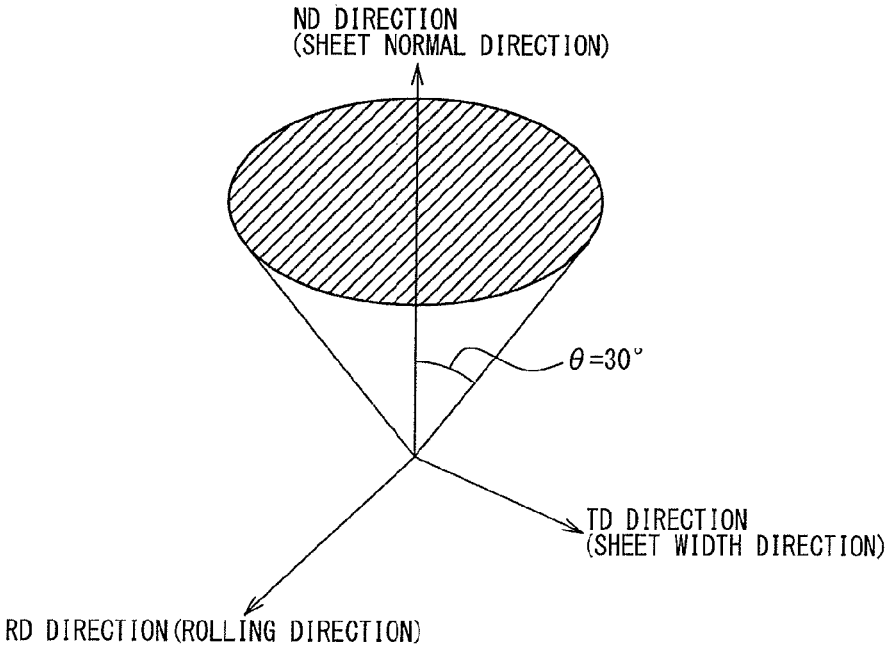
Figure 1C:
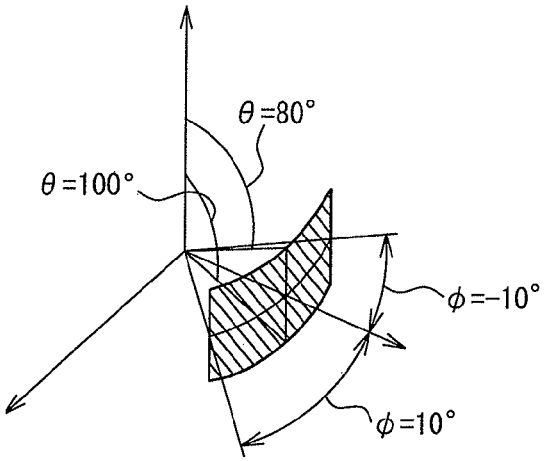

First, FIG. 1(*a*) shows a relative directional relationship between the crystal orientation and the sheet surface. The normal direction of a hot-rolled surface is taken as ND, the hot rolling direction is taken as RD, the hot-rolling width direction is taken as TD, the normal direction of the α-phase (0001) plane is taken as c-axis orientation, the angle formed between the c-axis orientation and the ND is taken as θ, and the angle formed between a plane including the c-axis orientation and the ND, and a plane including the ND and the TD is taken as φ.

As a result of studies, as described hereinabove, it has been found that, when the crystal structure has a hot-rolling texture (T-texture) in which the normal direction of a hexagonal basal plane ((0001) plane), that is, the c-axis orientation, of a titanium α phase of a hexagonal close-packed structure (hereinafter, sometimes referred to as "HCP") is strongly oriented in the TD, he crack propagation propensity in the TD, namely, the sheet width direction, can be suppressed and the sheet fracture is less liable to occur.

In the αtitanium composed of HCP, a crack is liable to propagate along the α-phase (0001) crystal plane, but in the T-texture, the c-axis orientation of the a phase may be oriented in the TD and therefore, the α-phase (0001) plane is liable to become parallel to a plane including the ND axis and the RD axis.

Further, slip deformation may readily be generated along (0001) plane and (10-10) plane of α phase, and upon crack propagation in the TD, a crack may be produced particularly along the (0001) plane. The crack may be slanted while allowing occurrence of plastic deformation accompanied by plastic relaxation at the distal end, and finally come to propagate in the RD, that is, the rolling direction (sheet longitudinal direction), to which a crack is liable to propagate.

Therefore, at the time of cold recoiling a hot-rolled coil and subjecting the hot-rolled coil to leveling or the like, a crack may be generated (i) initiating from edge cracking generated during hot rolling or (ii) even when edge cracking is being removed by trimming, initiating from edge cracking generated due to fluctuation or the like of a line tension during the cold recoiling, and upon the propagation in the TD, that is, the sheet width direction, the crack may be slanted toward the RD direction in a titanium alloy having a T-texture.

That is, in the case of a titanium alloy having a T-texture, as compared with a titanium alloy having no strong T-texture and hardly causing the bending of a crack, the fracture path of a crack may become longer, that is, the path leading to fracture may be long, and as a result, the sheet fracture is less liable to occur.

Accordingly, when the T-texture is formed in a titanium alloy, the crack propagation in the TD, which has inherently posed a problem therein, is less liable to occur. Further, even if a crack is generated and is propagated, the crack may be slanted in the RD so as to be kept from penetrating, so that the cold coil handling property can be enhanced.

Further, due to development of T-texture, the strength in the RD may be reduced and the ductility and flexural characteristics may be enhanced, so that the cold recoiling can be more facilitated and the handling property can be more improved, so as to provide an increased production yield.

For example, after a V-notch in a direction corresponding to the TD is formed in a Charpy impact test piece, which has been produced by arranging the RD of a hot-rolled sheet as the longitudinal direction of the test piece, a Charpy impact test may be performed at room temperature, and the insusceptibility to crack propagation in the TD of a hot-rolled sheet can be evaluated by the length of a crack developed from the notch bottom.

The reason for this is that, when the above-described test is performed on a sheet having a T-texture and hardly causing crack propagation in the TD, a crack may not be propagated straight from the notch bottom but may obliquely be propagated, and as a result, the fracture path may become long.

Figure 2:
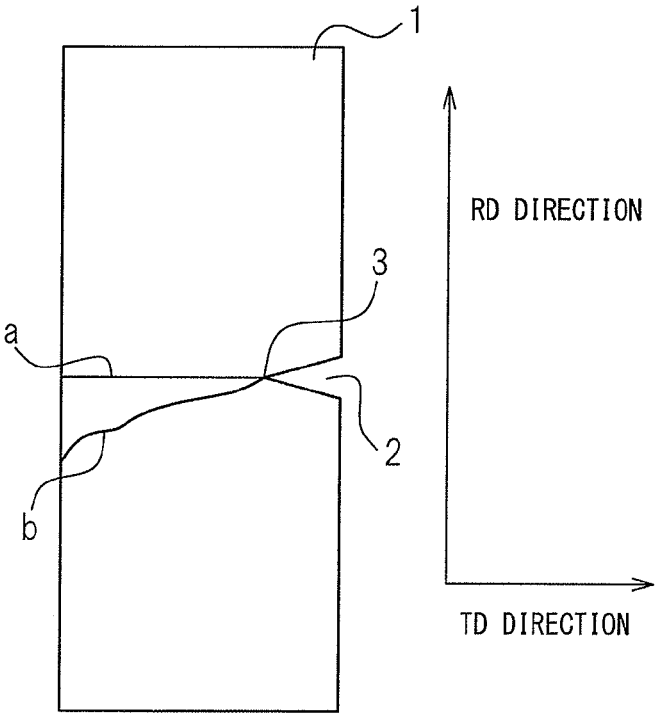
FIG. 2 is a view showing a fracture path in a Charpy impact test piece.

Here, FIG. 2 shows a fracture path in a Charpy impact test piece. As shown in FIG. 2, when the length of a perpendicular line drawn down vertically with respect to the longitudinal direction of the test piece from the notch bottom 3 of a notch 2 formed in the Charpy impact test piece 1 is "a" and the length of a crack actually propagated is "b", the ratio (=b/a) therebetween is defined as an "inclination index" in the present invention. When the inclination index exceeds 1.20, the fracture in the TD of a hot-rolled sheet is less liable to occur.

In this connection, a crack propagating in the test piece may not always proceed in one specific direction but may proceed in a zigzag manner. In either case, "b" indicates the entire length of the fracture path.

Also, when the T-texture is strengthened, the strength in the RD of a hot-rolled sheet may be reduced and the ductility and flexural characteristics may be enhanced, and as a result, the cold recoiling of a hot-rolled sheet coil may be facilitated, to thereby improve the handling property thereof. This is because (0001) of titanium α phase HCP may be oriented in parallel with a plane including ND axis and RD axis, or in a direction close thereto so that, among the main slip systems, the slip deformation using (10-10) plane as a slip plane may be activated.

The critical shear stress of this slip system may be low as compared with those of other slip systems and therefore, the deformation resistance in the RD of a hot-rolled sheet may be reduced, so as to enhance the ductility. Further, in the case where this slip system becomes a main slip system, the work hardening coefficient may also be reduced so as to facilitate light working such as leveling. In this way, handling property as a coil may be enhanced.

In the evaluation of the deformability in the RD of a hot-rolled sheet, a difference between the Vickers hardness (H1) of a cross-section perpendicular to the RD, and the Vickers hardness (H2) of a cross-section perpendicular to the TD, in a hot-rolled sheet, is multiplied by the Vickers hardness (H2) of a cross-section perpendicular to the TD, and the thus obtained value, which is, (H2−H1)·H2, is defined as the hardness anisotropy index and may be used as an evaluation scale.

When the hardness anisotropy index is 15,000 or more, the deformation resistance in the RD of a hot-rolled sheet may be sufficiently low and the recoiling property may be good.

Further, the present inventors have found that in an α+β titanium alloy, the hot-rolling heating temperature for obtaining a strong T-texture may be a certain temperature range of the β single-phase region. As compared with normal hot rolling in the α+β dual-phase region of an α+β titanium alloy, the above heating temperature may be high and therefore, not only good hot workability may be maintained but also temperature drop in both edge parts during the hot rolling may be suppressed, to thereby produce an effect that edge cracking is less liable to be generated.

As a result, the generation of edge cracking in a hot-rolled coil can be suppressed and this may be advantageous in that the amount of a waste trimmed-off from both edges at the time of trimming can be reduced. That is, when the above-described hot-rolling conditions are employed, the generation of edge cracking may be reduced, and the T-texture may be grown, so that the crack penetration is less liable to occur.

In addition, the present inventors have found that, when the contents of inexpensive elements Fe and Al and the contents of O and N are regulated, the T-texture can easily be built up, while maintaining the high strength.

As described hereinabove, Patent Document 3 discloses that the cold workability is enhanced by the effect of Si or C addition. However, the hot rolling conditions therein may show that, although the heating to β region is applied, the rolling is performed in the α+β region, and the enhancement of cold workability is not attributable to a texture such as T-texture.

Non-Patent Document 1 discloses that, when in pure titanium, the uni-directional rolling is always performed in the α region after the heating thereof to the β region, a texture analogous to a T-texture is formed. However, this rolling conditions relating to the pure titanium may be different from the rolling conditions of the present invention, for example, hot rolling may be started in α region, and in addition, there is no disclosure about the inhibition of cracking and the like during the hot rolling.

Patent Document 9 discloses a technique for starting the hot rolling of pure titanium in β region. However, this technique may be one for preventing the generation of wrinkles or scratches by refining the grain, and there is no disclosure about the evaluation of texture or the inhibition of cracking during the hot rolling.

Moreover, the present invention is intended for an α+β alloy containing, in mass %, from 0.8 to 1.5% of Fe and from 4.8 to 5.5% of Al and, containing O and N in defined amounts, and may be substantially different from the techniques relating to pure titanium or a titanium alloy close to pure titanium.

Patent Document 10 discloses an α+β titanium alloy of Ti—Fe—Al—O system for a golf club head, but this titanium alloy is a casting titanium alloy and is substantially different from the titanium alloy according to the present invention. Patent Document 11 discloses an α+β titanium alloy containing Fe and Al, but there is no disclosure about the evaluation of texture or the inhibition of cracking during hot rolling. Accordingly, this alloy is technically significantly different from that according to the present invention.

Patent Document 12 discloses a titanium alloy for a golf club head, having a chemical composition similar to that according to the present invention, but this technique may be characterized by controlling the Young's modulus by a final heat treatment, and there is no disclosure about the hot rolling conditions as well as the handling property and the texture of the hot-rolled sheet coil.

Accordingly, the techniques disclosed in Patent Documents 10 to 12 may be different from that of the present invention in view of the object and characteristic features.

As described hereinabove, the present inventors have investigated in detail the effect of a hot-rolling texture on the handling property in a recoiling or uncoiling step for performing cold leveling of a titanium alloy coil, so as to solve the problem described above, and as a result, the present inventors have found that, when the T-texture is stabilized, a crack is hardly developed in the TD of a hot-rolled sheet coil, the sheet fracture is less liable to occur, and the ductility and flexural characteristics in the RD are improved, to thereby improve the handling property during uncoiling.

The present invention has been accomplished based on this discovery. Hereinbelow, the present invention will be described in detail.

The reasons for the limitations of the crystal orientation and abundance ratio of titanium α phase specified in the high-strength α+β titanium alloy hot-rolled sheet according to the present invention (hereinafter, sometimes referred to "hot-rolled sheet according to the present invention") will be described below.

In an α+β titanium alloy, the crack propagation in the TD in an uncoiling step such as cold leveling step may be inhibited, when the T-texture is strongly grown. The present inventors have proceeded with intensive studies on the alloy design for growing the T-texture and the texture forming conditions and as a result, the present inventors have solved the problem in the following manner.

First, the degree of the texture growth was evaluated by using a ratio of (0002) relative reflection intensities of X-ray, which are reflection on a crystal plane parallel to the (0001) plane of α-phase and obtained by using the X-ray diffraction method.

Figure 3:
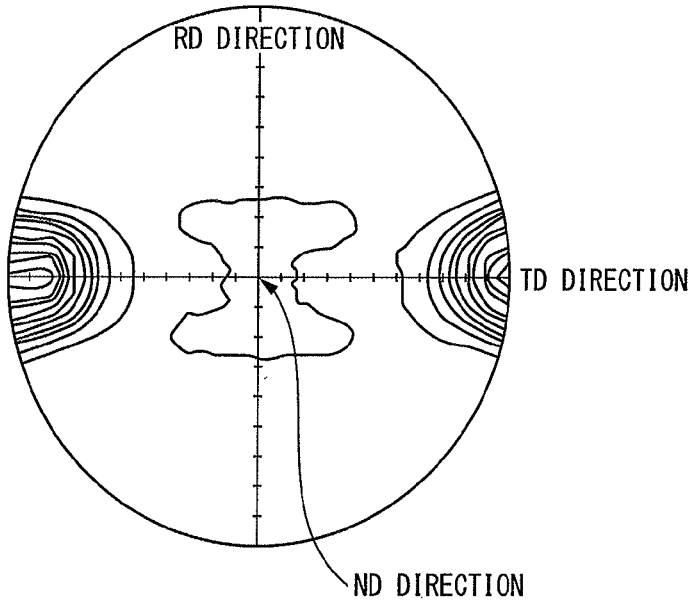
FIG. 3 is a view showing an example of the (0001) pole figure indicating the orientation distribution of the (0001) plane of α-phase.

FIG. 3 shows an example of the (0001) pole figure indicating the orientation distribution of the (0001) plane of α-phase. The (0001) pole figure shown in FIG. 3 is a typical example of the T-texture, and the c-axis orientation, as is the normal direction of the (0001) plane, is strongly oriented in the TD.

It may be seen from FIG. 3 that the (0001) crystal plane of the α phase is strongly oriented to a plane including the ND axis and the RD axis.

In this (0001) pole figure, among α-phase (0002) relative reflection intensities of X-ray by a grain, where θ formed between the c-axis orientation and the ND direction is from 0 to 30° (as shown by the hatching part in FIG. 1(*b*)), the highest intensity is taken as XND; among α-phase (0002) relative reflection intensities of X-ray caused by a grain, where θ formed between the c-axis orientation and the ND direction is from 80 to 100° and φ falls in ±10° (as shown by the hatching part in FIG. 1(*c*)), the highest intensity is taken as XTD; and the ratio (XTD/XND) thereof was evaluated for various titanium alloy sheets.

Figure 4:
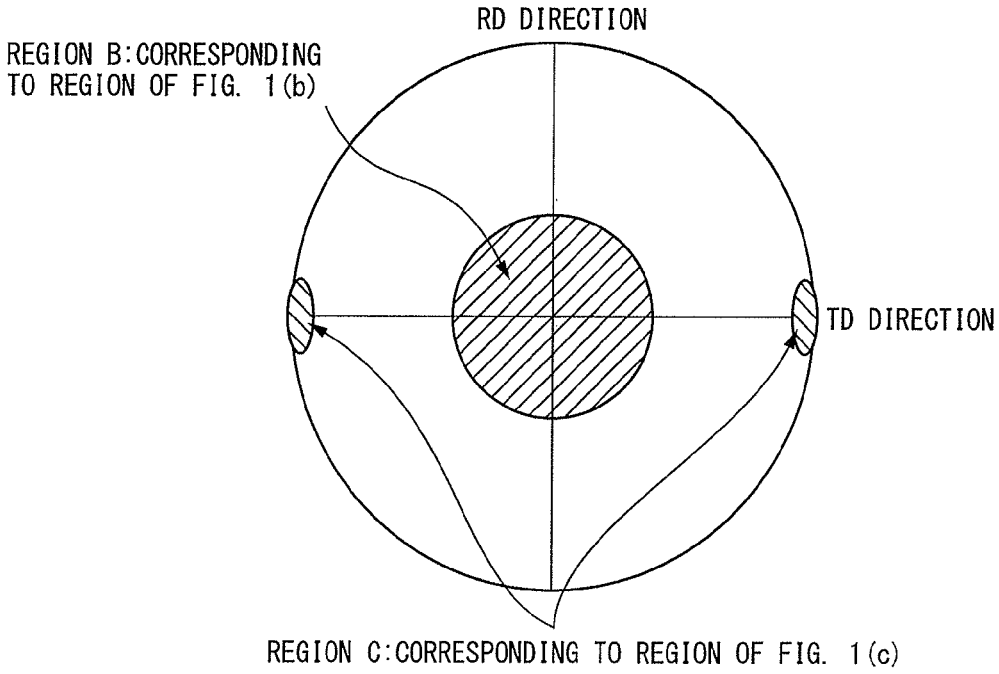
FIG. 4 is a view showing regions corresponding to the hatching parts of FIG. 1(*b*) and FIG. 1(*c*) in the (0001) pole figure of the titanium α phase.

Here, FIG. 4 shows the regions corresponding to the hatching parts of FIG. 1(*b*) and FIG. 1(*c*) in the (0001) pole figure of the titanium α phase.

The c-axis direction is (θ, φ) and when θ is larger than 90° by γ°, the direction thereof is equivalent to (90−γ, φ+180). That is, the hatching part of FIG. 1(*c*) including a region where θ is larger than 90° is equivalent to the hatching part indicated by the region C in the (0001) pole figure of the titanium α phase as shown in FIG. 4.

FIG. 4 schematically shows the measurement positions for XTD and XND on the (0001) pole figure, where XTD is a maximum peak value of the relative X-ray intensity in an azimuthal region formed by rotating both ends of the TD axis from 0 to 10° around the RD axis, and further rotating the resulting region ±10° around the ND axis and XND is a maximum peak value of the relative X-ray intensity in an azimuthal region formed by rotating the end of the ND axis of the sheet from 0 to 30° around the RD axis and, rotating it 360° around the ND axis.

The ratio (=XTD/XND) between those two values is defined as the X-ray anisotropy index, and the T-texture stability may be evaluated by the index and associated with the tendency of crack development in the TD during the uncoiling or recoiling for such as cold leveling. At this time, the above-described "hardness anisotropy. index" is used as the indication of the easiness of deformation in the RD direction. As the value is lower, the deformation in the RD may readily occur and recoiling may be facilitated.

In order to evaluate the deformability in the RD of a hot-rolled sheet, as described hereinabove, a difference between the Vickers hardness (H1) of a cross-section perpendicular to the RD and the Vickers hardness (H2) of a cross-section perpendicular to the TD, in a hot-rolled sheet, is multiplied by the Vickers hardness (H2) of a cross-section perpendicular to the TD, and the thus obtained value, that is, (H2−H1)·H2, is defined as the hardness anisotropy index and is used as an evaluation scale by the present inventors.

Figure 5:
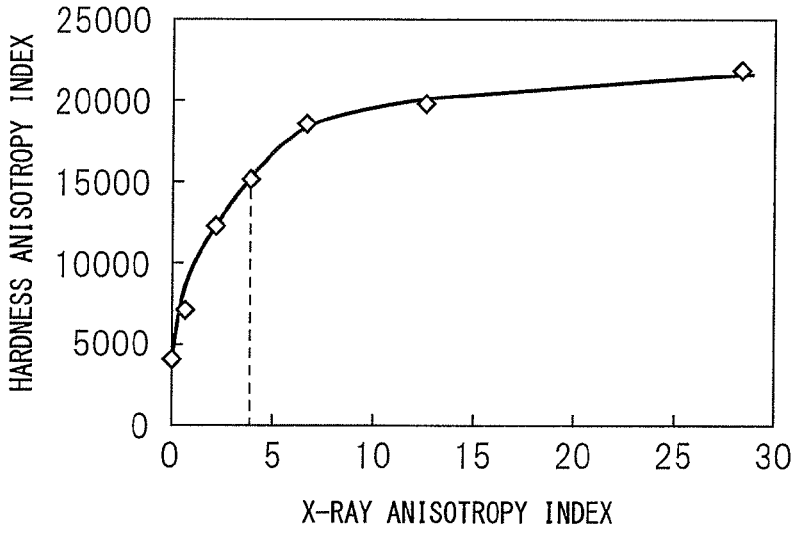
FIG. 5 is a view showing the relationship between the X-ray anisotropy index and the hardness anisotropy index.

FIG. 5 shows a relationship between the X-ray anisotropy index and the hardness anisotropy index. As the X-ray anisotropy index is higher, the hardness anisotropy index may also be higher. The deformation resistance during the recoiling was examined by using the same material, and as a result, it has been found that, when the hardness anisotropy index is 15,000 or more, the deformation resistance in the RD of a hot-rolled sheet during the uncoiling is sufficiently reduced, and the uncoiling property is remarkably enhanced. At this time, the X-ray anisotropy index is 4.0 or more, more preferably 5.0 or more.

Based on this discovery, the lower limit of XTD/XND is limited to 4.0, that is, the ratio of a peak value "XTD" to a peak value "XND" of the relative X-ray intensity, wherein the peak value "XTD" corresponds to an azimuth angle inclined by 0 to 10° to the ND direction of the sheet from the sheet width direction on the (0001) pole figure, and an azimuth angle rotated by ±10° and ±180° from the sheet width direction by using the ND of the sheet as the central axis; and the peak value "XND" corresponds to an azimuth angle inclined by 0 to 30° to the TD from the ND of the sheet, and an azimuth angle rotated around the entire circumference by using the normal line of the sheet as the central axis.

The reasons for the limitation of the chemical composition of the hot-rolled sheet according to the present invention will be described below. In the following, "%" relating to the component composition means "mass %".

Fe is an inexpensive element among β phase stabilizing elements and therefore, the β phase may be strengthened by adding Fe. In order to improve the coil handling property by causing a crack in the TD to be slanted and to extend during the uncoiling such as cold leveling, and to reduce the deformation resistance in the RD of a hot-rolled sheet, a strong T-texture should be obtained as a hot-rolling texture. For the purpose of realizing this, a β phase stable at a hot-rolling heating temperature should be obtained.

Fe may have a high β stabilizing ability and can stabilize a β phase by its addition in a relatively small amount, so that the amount thereof to be added can be small, as compared with that of other β stabilizing elements. Accordingly, the degree of solid solution strengthening by Fe at room temperature may be small, and the titanium alloy can maintain a high ductility.

That is, the deformation resistance in the RD during coil handling may be kept from becoming high, to thereby facilitate the recoiling, and, when a crack propagates in the TD, plastic relaxation is liable to occur at the distal end of a crack, so that the crack may easily be slanted. At this time, for the purpose of obtaining a stable β phase in the hot-rolling temperature region, Fe should be added in an amount of 0.8% or more.

On the other hand, Fe may readily segregate in Ti and also, when it is added in a large amount, solid solution strengthening is liable to occur, so as to reduce the ductility and to deteriorate the coil handling property. In consideration of these effects, the upper limit of the amount of Fe added is set to 1.5%.

Al may be a titanium α phase stabilizing element and may be an inexpensive additive element having a high solid solution strengthening ability. The lower limit of the amount thereof to be added is set to 4.8% so that a strength level of 1,050 MPa or more, in terms of tensile strength in the TD, more preferably 1,100 MPa or more, which is necessary for a high-strength α+β titanium alloy, can be obtained by the combined addition with the later-described O and N.

On the other hand, if Al is added in excess of 5.5%, the deformation resistance may become too high and not only the ductility may be reduced, making it impossible to maintain a characteristic feature that when sheet fracture occurs, plastic deformation is adequately caused at the distal end of a crack and fracture in the TD is less liable to occur, but also the hot workability may be deteriorated due to an increase in the hot deformation resistance. For this reason, the amount of Al to be added is set to 5.5% or less.

N may form a solid solution as an interstitial element in the α phase and exert a solid solution strengthening action. However, if it is added in excess of 0.030% by, for example, a method using a sponge titanium containing relatively high concentration of N, an undissolved inclusion called LDI may readily be produced and the yield of the product may be reduced. For this reason, the upper limit of the amount of N added is set to 0.030%.

Similarly to the case of N, O may form a solid solution as an interstitial element in the α phase and exert a solid solution strengthening action. It has also been found that when O and N are present together, this may contribute to an increase in the strength according to the value Q defined by the following formula (1):

$$Q=[O]+2.77\cdot[N] \quad (1)$$

wherein [O]: the content (mass %) of O, and [N]: the content (mass %) of N.

In formula (1), the coefficient 2.77 of [N] is a coefficient indicating the degree of contribution to the increase in the strength and was empirically determined based on a large number of experimental data.

If the value Q is less than 0.14, sufficient strength as a high-strength α+β titanium alloy may not be obtained, whereas if the value Q exceeds 0.38, the strength may be excessively increased, and the ductility may be extremely reduced, making it difficult to cause plastic relaxation at the distal end of a crack when sheet fracture occurs, and as a result, the fracture in the TD may readily occur. For this reason, the value Q has a lower limit of 0.14 and an upper limit of 0.38.

Hereinbelow, the process for producing the high-strength α+β titanium alloy hot-rolled sheet according to the present invention (hereinafter, sometimes referred to as "production process according to the present invention") will be described. The production process according to the present invention is particularly a process for producing for improving the coil handling property by growing the T-texture and not easily allowing a crack to develop in the sheet width direction during the uncoiling or recoiling for such as cold leveling.

The production process according to the present invention is a process for producing a thin sheet having the crystal orientation and titanium alloy components of the hot-rolled sheet according to the present invention, characterized by performing uni-directional hot-rolling such that the heating temperature prior to the hot rolling is not less than β transformation temperature and not more than (β transformation temperature +150° C.), the sheet thickness reduction ratio is 80% or more, and the hot rolling finishing temperature is not less than (β transformation temperature −250° C.) and not more than (β transformation temperature −50° C.)

In order to form the hot-rolling texture as a strong T-texture and ensure strong anisotropy in mechanical properties, it may be necessary that a titanium alloy is heated to the β single-phase region, held for 30 minutes or more, to thereby once put into a β single-phase state, and further, added with a rolling reduction as large as a sheet thickness reduction ratio of 90% or more from the β single-phase region to the α+β two-phase region.

The β transformation temperature can be measured by using differential thermal analysis. By use of test pieces produced by vacuum melting and forging 10 or more. kinds of materials, each in a small amount of the laboratory level, where the concentrations of Fe, Al, N and O are changed within the range of the chemical composition to be produced, the β→α transformation temperature and the temperature after the completion of transformation are previously examined by the differential thermal analysis wherein each of the test pieces is gradually cooled from the β single-phase region of 1,100° C.

At the time of the actual production of a titanium alloy, whether the alloy is in the β single-phase region or in the α+β region can be judged on the spot (or in situ), from the chemical composition of the production material and by the temperature measurement by use of a radiation thermometer.

At this time, if the heating temperature is lower than the β transformation temperature, or further the hot rolling finishing temperature is lower than (the β transformation temperature −250° C.), the phase transformation from β to α may occur in the course of the hot rolling, and as a result, a large rolling reduction may be added in the state of the α phase fraction being high and a rolling reduction in the dual-phase state having a high β phase fraction may become insufficient, so that the T-texture can be insufficiently developed.

In addition, when the hot rolling finishing temperature becomes not higher than (the β transformation temperature −250° C.), the hot deformation resistance may abruptly be increased and the hot workability may be deteriorated, and as a result, the edge cracking or the like may readily be generated so as to cause a reduction in the production yield. For this reason, the lower limit of the heating temperature prior to the hot rolling should be the β transformation temperature, and the lower limit of the hot rolling finishing temperature should be not lower than (the β transformation temperature −250° C.)

At this time, if the rolling reduction ratio (i.e., sheet thickness reduction ratio) from the β single-phase region to the α+β dual-phase region is lower than 90%, the amount of strain introduced during hot rolling thereby may be insufficient, so that the uniform introduction of the stain throughout the sheet thickness is less liable to be obtained, and the T-texture may not be adequately developed in some cases. For this reason, the sheet thickness reduction ratio during the hot rolling should be 90% or higher.

Also, if the heating temperature during the hot rolling exceeds (the β transformation temperature +150° C.), the β grain may abruptly be coarsened. In this case, the hot rolling may be performed almost in the β single-phase region and the coarse β grain may be stretched in the rolling direction, so that the phase transformation from β to α takes place therefrom, and as a result, the T-texture can be hardly developed.

Further, the oxidation of the surface of the hot-rolled material may vigorously proceeds, and there may becaused a production problem, for example, a scab or a scratch may readily be produced on the hot-rolled sheet surface after the hot rolling. For this reason, the upper limit of the heating temperature during the hot rolling is set to (the β transformation temperature +150° C.)

Also, if the hot rolling finishing temperature exceeds (the β transformation temperature −50° C.), the hot rolling may be mostly performed in the β single-phase region, and the orientation integration of a recrystallized α grain from β grain may not be sufficient, so that the development of the T-texture may be insufficient. For this reason, the upper limit of the hot rolling finishing temperature is set to (the β transformation temperature −50° C.)

On the other hand, if the hot rolling finishing temperature is lower than (the β transformation temperature −250° C.), the effect of hot rolling with a high reduction in a region having a high α phase fraction may become predominant, and adequate growth of the T-texture by the heating and hot rolling in the β single-phase region, which is intended in the present invention, may be inhibited. Further, at such a low hot rolling finishing temperature, the hot deformation resistance may abruptly be increased so as to deteriorate the hot workability, and the edge cracking may readily be generated, so as to reduce the production yield. For this reason, the hot rolling finishing temperature is set not lower than (the β transformation temperature −250° C.) and not higher than (the β transformation temperature −50° C.).

Also, in the hot rolling process under the above-described conditions, the hot rolling temperature may be high, as compared with the heating and hot rolling in the α+β region which is the normal hot-rolling conditions for an α+β titanium alloy, and therefore, a decrease in the temperature at both ends of the sheet may be suppressed. In this way, the hot rolling under those conditions may be advantageous in that good hot workability is maintained even at both ends in the width direction of the sheet and the generation of edge cracking is inhibited.

Incidentally, the reason for performing the rolling only in one direction consistently from the start to the end of the hot rolling is to efficiently obtain a T-texture which is capable of preventing the crack development in the TD and of enhancing the ductility and flexural characteristics in the RD of a hot-rolled sheet, in the case of cold leveling or trimming a hot-rolled coil, which is intended in the present invention.

In this way, it is possible to obtain a titanium alloy thin-sheet coil which is capable of ensuring that the sheet fracture is less liable to occur at the time of cold recoiling a hot-rolled coil, and that the flexural property or ductility in the RD of a hot-rolled sheet is high so as to facilitate the recoiling.

EXAMPLES

Hereinbelow, the present invention will be described by referring to Examples, but the conditions in Examples may be one condition example employed to confirm the practicability and effect of the present invention, and the present invention may not be limited to such a condition example. In the present invention, as long as the object of the present invention can be achieved, various conditions may be employed without departing from the gist of the present invention.

Example 1

A titanium material having the composition shown in Table 1 was melted by vacuum arc melting, and the resultant ingot was hot forged to a slab, then heated at 1,060° C. and thereafter, was hot-rolled with a sheet thickness reduction ratio of 95%, to thereby obtain a 4-mm thick-hot-rolled sheet. The hot-rolling finishing temperature was 830° C.

The thus obtained hot-rolled sheet was pickled so as to remove oxide scale, and a sample as a tensile test piece was taken therefrom, and then the tensile characteristics thereof were examined, and the texture in the sheet surface direction was measured by using X-ray diffraction (by use of RINT 2100 mfd. by Rigaku Corporation; Cu-Kα, voltage: 40 kV, current: 300 mA).

In the (0001) plane pole figure of α-phase from the ND of the hot-rolled sheet, among α-phase (0002) relative reflection intensities of X-ray by a grain shown by the hatching part in FIG. 1(*b*), where the angle θ formed between the c-axis orientation and the ND is 30° or less, the highest intensity was taken as "XND"; among α-phase (0002) relative reflection intensities of X-ray caused by a crystal grain shown by the hatching part in FIG. 1(*c*), where the angle θ formed between the c-axis orientation and the ND is from 80 to 100° and φ falls in ±10°, the highest intensity was taken as "XTD"; and the degree of texture growth was evaluated by using the ratio (XTD/XND) therebetween as an X-ray anisotropy index.

In the evaluation of the insusceptibility to the sheet fracture, an impact test was performed at ordinary temperature in accordance with JIS Z2242 by using a Charpy impact test piece (with a 2-mm V-notch; the notch was formed in the TD of the hot rolled sheet), which had been sampled by arranging the RD of the hot-rolled sheet as the longitudinal direction of the test piece. The insusceptibility to the sheet fracture was evaluated by using the ratio (i.e., fracture inclination index (b/a), as shown in FIG. 2) between the length (b) of the fracture path in the test piece after the impact test, and the length (a) of a perpendicular line drawn down from the V-notch bottom.

When the fracture inclination index exceeds 1.20, the fracture path of a crack in the TD may become sufficiently long, and as compared with the case of a fracture inclination index of 1.20 or lower, the sheet fracture is hardly liable to occur. The fracture inclination index was evaluated by taking the percentage elongation of the hot-rolled sheet (={sheet length after leveling−sheet length before leveling)/(sheet length before leveling)}·100%) as 1.5%, and sampling the impact test piece from a sheet after cold tension leveling.

Further, the deformability in the RD of the hot-rolled sheet was evaluated by using the hardness anisotropy index. As the hardness, the Vickers hardness with a load of 1 kgf was evaluated in accordance with JIS Z2244. When the hardness anisotropy index is 15,000 or more, the deformation resistance in the RD of the hot-rolled sheet may be sufficiently low, and good recoiling property may be obtained. The results of evaluating these characteristics are shown together in Table 1.

TABLE 1

| Test No. | Al (mass %) | Fe (mass %) | O (mass %) | N (mass %) | Q (mass %) | β Transformation Temperature (° C.) | X-Ray Anisotropy Index (XTD/XND) | Tensile Strength in Transverse Direction (MPa) | Hardness Anisotropy Index | Fracture Inclination Index (hot-rolled sheet) | Fracture Inclination Index (Tension Leveled with percentage Elongation of 1.5%) | Remarks |
|---|---|---|---|---|---|---|---|---|---|---|---|---|
| 1 | 1.5 | 1.1 | 0.15 | 0.004 | 0.16 | 1002 | 0.15 | 1045 | 6560 | 1.01 | 1.02 | Comparative Example |
| 2 | 5.0 | 0.8 | 0.19 | 0.005 | 0.20 | 1008 | 1.39 | 1060 | 7872 | 1.04 | 1.05 | Comparative Example |
| 3 | 3.9 | 1.2 | 0.17 | 0.005 | 0.18 | 976 | 5.62 | 981 | 16170 | 1.37 | 1.38 | Comparative Example |
| 4 | 4.9 | 1.2 | 0.17 | 0.005 | 0.18 | 996 | 7.75 | 1097 | 18648 | 1.47 | 1.47 | Invention |
| 5 | 5.3 | 1.2 | 0.17 | 0.005 | 0.18 | 1005 | 6.78 | 1125 | 17649 | 1.41 | 1.41 | Invention |
| 6 | 6.0 | 1.2 | 0.17 | 0.005 | 0.18 | 1021 | 5.89 | 1246 | 16176 | 1.40 | 1.40 | Comparative Example |
| 7 | 5.1 | 0.2 | 0.26 | 0.006 | 0.28 | 1028 | 3.74 | 1021 | 13240 | 1.11 | 1.12 | Comparative Example |
| 8 | 5.1 | 1.0 | 0.26 | 0.006 | 0.28 | 1014 | 7.78 | 1111 | 18006 | 1.54 | 1.55 | Invention |
| 9 | 5.1 | 1.3 | 0.26 | 0.006 | 0.28 | 1008 | 8.96 | 1156 | 18704 | 1.55 | 1.54 | Invention |
| 10 | 5.1 | 2.0 | 0.26 | 0.006 | 0.28 | 996 | 8.85 | 1275 | 18981 | 1.17 | 1.17 | Comparative Example |
| 11 | 4.8 | 0.9 | 0.10 | 0.001 | 0.10 | 991 | 6.13 | 934 | 16600 | 1.41 | 1.40 | Comparative Example |
| 12 | 4.8 | 0.9 | 0.16 | 0.002 | 0.17 | 998 | 7.68 | 1087 | 18098 | 1.58 | 1.57 | Invention |
| 13 | 4.8 | 0.9 | 0.27 | 0.002 | 0.28 | 1010 | 7.31 | 1164 | 17596 | 1.39 | 1.40 | Invention |

TABLE 1-continued

| Test No. | Al (mass %) | Fe (mass %) | O (mass %) | N (mass %) | Q (mass %) | β Transformation Temperature (° C.) | X-Ray Anisotropy Index (XTD/XND) | Tensile Strength in Transverse Direction (MPa) | Hardness Anisotropy Index | Fracture Inclination Index (hot-rolled sheet) | Fracture Inclination Index (Tension Leveled with percentage Elongation of 1.5%) | Remarks |
|---|---|---|---|---|---|---|---|---|---|---|---|---|
| 14 | 4.8 | 0.9 | 0.40 | 0.002 | 0.41 | 1026 | 7.88 | 1297 | 18205 | 1.57 | 1.56 | Comparative Example |
| 15 | 4.8 | 0.9 | 0.23 | 0.044 | 0.35 | 1011 | — | — | — | — | — | Comparative Example |
| 16 | 5.3 | 0.9 | 0.16 | 0.011 | 0.19 | 1009 | 4.81 | 1088 | 15840 | 1.52 | 1.53 | Invention |
| 17 | 4.7 | 0.7 | 0.32 | 0.012 | 0.35 | 1017 | 8.14 | 1221 | 17874 | 1.56 | 1.55 | Invention |

Q = [O] + 2.77*[N]

In Table 1, Test Nos. 1 and 2 show the results of an α+β titanium alloy produced by a process where hot rolling in the sheet width direction is included. In both of Test Nos. 1 and 2, the hardness anisotropy index is lower than 15,000, the strength in the RD of the hot-rolled sheet is high so as to produce a large resistance at the recoiling, and accordingly, the handling property is poor.

Also, the fracture inclination index is fairly lower than 1.20, and the fracture path in the TD is short, so that sheet the fracture is liable to occur. In all of these materials, the value of XTD/XND is below 4.0, and it is understood that the T-texture is not grown.

In contrast thereto, in Test Nos. 4, 5, 8, 9, 12, 13, 16 and 17, which are Examples of the hot-rolled sheet according to the present invention produced by the production process according to the present invention, the hardness anisotropy index is 15,000 or higher so as to reveal good recoiling property, and, the fracture inclination index exceeds 1.20, so as to exhibit a property that a crack in the TD is inclined and the sheet fracture is less liable to occur. Here, the hardness was evaluated by the Vickers hardness.

On the other hand, Test Nos. 3, 7 and 11 are low in the strength, as compared with other materials and fail to achieve a tensile strength of higher than 1,050 MPa, which is a characteristic value in the TD generally required of a high-strength α+β alloy sheet product in an application, where the material anisotropy is not considered.

Among these, in Test Nos. 3 and 7 where the amount of Al added and the amount of Fe added, respectively, fall below the respective lower limits of the amounts added of Al and Fe in the hot-rolled sheet according to the present invention, the tensile strength in the sheet width direction is low. Also, in Test No. 11 where the nitrogen and oxygen contents are low and the oxygen equivalent value Q falls below the lower limit of the defined amount, the tensile strength in the TD direction is lower than the sufficiently high level.

In Test Nos. 6, 10 and 14 where not only the X-ray anisotropy index exceeds 4.0 but also the hardness anisotropy index satisfies the condition of 15,000 or more, but the inclination index falls below 1.20, the fracture readily develops in the width direction of the sheet.

In Test Nos. 6, 10 and 14 where the amounts of Al and Fe added and the Q value exceed respective upper limits of the present invention, the strength is excessively increased, so as to reduce the ductility, and the bending of a crack toward the TD is less liable to occur due to plastic relaxation.

In Test No. 15, a lot of defects were generated in many portions of the hot-rolled sheet and the yield of the product was low, so that the characteristics could not be evaluated. This is because N was added in excess of the upper limit of the present invention by a normal method by using a high N-content sponge titanium as a raw material and numerrous LDIs were produced.

As understood from these results, in a titanium alloy hot-rolled sheet having the element contents and XTD/XND specified in the present invention, the crack path in the TD is prolonged so as to make it difficult to cause sheet fracture and, the strength in the RD direction of the hot-rolled sheet is reduced, so as to exhibit excellent uncoiling and/or recoiling property, but when the alloy element amounts and XTD/XND fall outside the definitions of the present invention, strong material anisotropy and various characteristics associated therewith, such as excellent recoiling and/or uncoiling property and insusceptibility to sheet fracture, cannot be satisfied.

Example 2

The material of each of Test Nos. 4, 8 and 17 in Table 1 was hot-rolled under various conditions as shown in Tables 2 to 4 and then pickled so as to remove surface oxide scale. Thereafter, the tensile characteristics were examined and, the degree of development of texture was evaluated by using, the X-ray anisotropy index, where the ratio XTD/XND wherein at the time of measuring the sheet surface direction by X-ray diffraction (using RINT 2100 mfd. by Rigaku Corporation; Cu-Kα, voltage: 40 kV, current: 300 mA), "XTD" is a peak value of the relative X-ray intensity in an azimuth angle inclined by 0 to 10° to the ND of the sheet from the TD on the (0002) pole figure of titanium, and an azimuth angle rotated by ±10° from the TD by using the ND of the sheet as the central axis and "XND" is a peak value of the relative X-ray intensity in an azimuth angle inclined by 0 to 30° to the TD from the ND of the hot-rolled sheet and an azimuth angle rotated around the entire circumference by using the normal line of the sheet as the central axis.

Similarly to Example 1, an impact test was performed at ordinary temperature in accordance with JIS Z2242 by using a Charpy impact test piece (with a 2-mm V-notch; the notch was formed in the TD) sampled in the RD of the hot-rolled sheet, and the insusceptibility to sheet fracture was evaluated by the ratio (fracture inclination index (b/a), as shown in FIG. 2) between the length (b) of a fracture path and the length (a) of a perpendicular line drawn down from the V-notch bottom.

When the fracture inclination index exceeds 1.20, the sheet fracture is hardly liable to occur. The fracture inclination index was evaluated by sampling impact test pieces from the hot-rolled sheet and a sheet after tension leveling in which the amount of deformation corresponds to a percentage elongation of 1.5% in longitudinal direction. In the evaluation of the deformability in the RD of the hot-rolled sheet, a hardness anisotropy index was used. The hardness was evaluated by the Vickers hardness at a load of 1 kgf in accordance with JIS Z2244. When the hardness anisotropy index is 15,000 or more, the recoiling property is good. The results of evaluating these characteristics are shown in Tables 2 to 4.

TABLE 2

| Test No. | Sheet Thickness Reduction Ratio (%) | Heating Temperature Prior to Hot Rolling (° C.) | Hot-Rolling Finishing Temperature (° C.) | X-Ray Anisotropy Index (XTD/XND) | Tensile Strength in Transverse Direction (MPa) | Hardness Anisotropy Index | Fracture Inclination Index (hot-rolled sheet) | Fracture Inclination Index (Tension leveled with percentage Elongation of 1.5%) | Remarks |
|---|---|---|---|---|---|---|---|---|---|
| 18 | 92.9 | 1080 | 878 | 6.47 | 1099 | 16500 | 1.48 | 1.48 | Invention |
| 19 | 95.7 | 1050 | 834 | 7.88 | 1096 | 18648 | 1.51 | 1.51 | Invention |
| 20 | 82.1 | 1025 | 798 | 2.31 | 1034 | 9860 | 1.11 | 1.11 | Comparative Example |
| 21 | 95.0 | 970 | 753 | 1.38 | 1022 | 6993 | 1.09 | 1.09 | Comparative Example |
| 22 | 92.6 | 1180 | 901 | 2.11 | 1045 | 9628 | 1.08 | 1.08 | Comparative Example |
| 23 | 96.3 | 1025 | 753 | 2.22 | 1055 | 9295 | 1.14 | 1.14 | Comparative Example |
| 24 | 93.0 | 1120 | 990 | 1.89 | 1037 | 7238 | 1.11 | 1.11 | Comparative Example |

The β transformation temperature is 996° C.

TABLE 3

| Test No. | Sheet Thickness Reduction Ratio (%) | Heating Temperature prior to Hot Rolling (° C.) | Hot-Rolling Finishing Temperature (° C.) | X-Ray Anisotropy Index (XTD/XND) | Tensile Strength in transverse Direction (MPa) | Hardness Anisotropy Index | Fracture Inclination Index (hot-rolled sheet) | Fracture Inclination Index (tension leveled with percentage Elongation of 1.5%) | Remarks |
|---|---|---|---|---|---|---|---|---|---|
| 25 | 90.2 | 1100 | 865 | 8.86 | 1112 | 18981 | 1.44 | 974.00 | Invention |
| 26 | 94.1 | 1040 | 902 | 5.99 | 1098 | 16176 | 1.40 | 958.00 | Invention |
| 27 | 73.0 | 1050 | 834 | 2.11 | 1056 | 9860 | 1.11 | 976.00 | Comparative Example |
| 28 | 91.6 | 980 | 789 | 1.18 | 1043 | 6308 | 1.09 | 956.00 | Comparative Example |
| 29 | 93.5 | 1200 | 1030 | 2.43 | 1078 | 9599 | 1.14 | 928.00 | Comparative Example |
| 30 | 95.1 | 1040 | 698 | 1.26 | 1096 | 6930 | 1.05 | 987.00 | Comparative Example |
| 31 | 92.4 | 1100 | 990 | 1.44 | 1102 | 6270 | 1.09 | 924.00 | Comparative Example |

The β transformation temperature is 1,014° C.

TABLE 4

| Test No. | Sheet Thickness Reduction Ratio (%) | Heating Temperature prior to Hot Rolling (° C.) | Hot-Rolling Finishing Temperature (° C.) | X-Ray Anisotropy Index (XTD/XND) | Tensile Strength in transverse Direction (MPa) | Hardness Anisotropy Index | Fracture Inclination Index (hot-rolled sheet) | Fracture Inclination Index (tension leveled with percentage Elongation of 1.5%) | Remarks |
|---|---|---|---|---|---|---|---|---|---|
| 32 | 93.5 | 1050 | 820 | 4.86 | 1209 | 15840 | 1.48 | 1.48 | Invention |
| 33 | 97.6 | 1080 | 883 | 6.71 | 1231 | 17596 | 1.51 | 1.50 | Invention |
| 34 | 76.8 | 1015 | 886 | 2.21 | 1189 | 9295 | 1.06 | 1.06 | Comparative Example |
| 35 | 91.9 | 970 | 796 | 1.78 | 1176 | 7613 | 1.09 | 1.08 | Comparative Example |
| 36 | 94.8 | 1200 | 930 | 2.35 | 1207 | 8658 | 1.11 | 1.11 | Comparative Example |

TABLE 4-continued

| Test No. | Sheet Thickness Reduction Ratio (%) | Heating Temperature prior to Hot Rolling (° C.) | Hot-Rolling Finishing Temperature (° C.) | X-Ray Anisotropy Index (XTD/XND) | Tensile Strength in transverse Direction (MPa) | Hardness Anisotropy Index | Fracture Inclination Index (hot-rolled sheet) | Fracture Inclination Index (tension leveled with percentage Elongation of 1.5%) | Remarks |
|---|---|---|---|---|---|---|---|---|---|
| 37 | 95.3 | 1030 | 698 | 1.64 | 1159 | 5627 | 1.07 | 1.08 | Comparative Example |
| 38 | 95.6 | 1140 | 970 | 1.32 | 1178 | 4329 | 1.06 | 1.06 | Comparative Example |

The β transformation point is 1,017° C.

Tables 2, 3 and 4 show the evaluation results of hot-rolled and annealed sheets having chemical compositions of Test Nos. 4, 8 and 17. Test Nos. 18, 19, 25, 26, 32 and 33 which are Examples of the hot-rolled sheet according to the present invention produced by the production process according to the present invention show a hardness anisotropy index of 15,000 or more and, shows a fracture inclination index exceeding 1.20, so as to reveal that the sheet has good recoiling property and insusceptibility to sheet fracture.

On the other hand, in Test Nos. 20, 27 and 34, the fracture inclination index falls below 1.20, and the sheet fracture readily occurs. This is because the sheet thickness reduction ratio during the hot rolling is below the lower limit of the present invention and the T-texture cannot develop sufficiently, so as to provide a state where a crack in the TD is liable to be developed straight in the width direction of the sheet.

In Test Nos. 21, 22, 23, 24, 28, 29, 30, 31, 35, 36, 37 and 38, the X-ray anisotropy index falls below 40, the hardness anisotropy index falls below 15,000, and the fracture inclination index also falls below 1.20.

Among these, in Test Nos. 21, 28. and 35 where the heating temperature prior to hot rolling falls below the lower limit of the present invention and Test Nos. 23, 30 and 37 where the hot-rolling finishing temperature falls below the lower limit of the present invention, all are examples failing in achieving adequate hot rolling in the α+β two-phase region with a sufficiently high β phase fraction and in fully developing the T-texture.

Test Nos. 22, 29 and 36 where the heating temperature prior to hot rolling exceeds the upper limit temperature of the present invention and Test Nos. 24, 31 and 38 where the hot-rolling finishing temperature exceeds the upper limit temperature of the present invention, all of these are examples in which the hot rolling process is performed mostly in the β single-phase region, that is, on the high-temperature side, the T-texture is weakly developed or unstable T-texture is formed due to the hot rolling courser β grains, the hardness anisotropy index does not become high due to the formation of a coarse final microstructure, and a fracture path is not prolonged.

As understood from these results, an α+β titanium alloy sheet material with high coil handling property, exhibiting, at the time of uncoiling and or recoiling for such as cold leveling of a hot-rolled coil, characteristics such as easiness and smoothness of recoiling and/or uncoiling by virtue of improving bendability and the like and insusceptibility to the fracture in the TD, can be produced by hot-rolling a titanium alloy having the texture and chemical composition specified in the present invention, in the ranges of sheet thickness reduction ratio, heating temperature prior to hot rolling and hot rolling finishing temperature of the present invention so as to lower the deformation resistance in the RD of the hot-rolled sheet and impart a property of making a crack in the TD be inclined.

INDUSTRIAL APPLICABILITY

The present invention can provide a titanium alloy hot-rolled sheet coil product exhibiting good handling property during uncoiling and/or recoiling for such as cold leveling. The product according to the present invention can be used widely, for example, in consumer application such as golf club face, and automotive component application and therefore, the present invention has high industrial applicability.

DESCRIPTION OF REFERENCE NUMERALS

1 Charpy impact test piece
2 Notch
3 Notch bottom
a Length of perpendicular line drawn down from notch bottom
b Length of actual fracture path

The invention claimed is:

1. An α+β titanium alloy hot-rolled sheet, comprising, in mass %, Fe: 0.8 to 1.5%, Al: 4.8 to 5.5%, and N: 0.030% or less, and, containing O and N to satisfy the condition that Q defined by the following formula (1) is 0.14 to 0.38, with the balance being Ti and unavoidable impurities, wherein, (a) the normal direction of a hot-rolled sheet is taken as ND, the hot rolling direction is taken as RD, the hot-rolling width direction is taken as TD, the normal direction of the α-phase (0001) plane is taken as c-axis orientation, the angle formed between the c-axis orientation and the ND is taken as θ, and the angle formed between a plane including the c-axis orientation and the ND, and a plane including the ND and the TD is taken as φ;

(b1) among (0002) relative reflection intensities of X-ray by grains where θ is from 0 to 30° and φ falls in the entire circumference from −180 to 180° , the highest intensity is taken as XND;

(b2) among (0002) relative reflection intensities of X-ray caused by grains where θ is from 80 to less than 100° and φ falls in ±10° , the highest intensity is taken as XTD; and (c) XTD/XND is 4.0 or more:

$$Q = [O] + 2.77 \cdot [N] \quad (1)$$

wherein [O]: the mass % content of O, and [N]: the mass % content of N.

2. The α+β titanium alloy hot-rolled sheet according to claim 1, wherein (d) the Vickers hardness of a cross-section perpendicular to the RD direction of the hot-rolled sheet is H1, and the Vickers hardness of a cross-section perpendicular to the TD direction H2, the hardness anisotropy index represented by (H2-H1).H2 is 15,000 or more, and (e) in a Charpy test piece sampled from the hot-rolled sheet, where the RD is the test piece longitudinal direction and a notch with a depth of 2 mm is formed in the TD, the length of a perpendicular line drawn down vertically from the notch bottom to the opposing surface is "a" and the length of a crack actually propagated after the test is "b", the fracture inclination index represented by "b/a" is 1.20 or more.

3. A process for producing the α+β titanium alloy hot-rolled sheet according to claim 1, wherein at the time of hot-rolling an α+β titanium alloy, the titanium alloy is heated to a temperature ranging from β transformation temperature to β transformation temperature +150° C., and hot-rolled uni-directionally by setting the hot rolling finishing temperature to be in a range of from β transformation temperature −250° C. to β transformation temperature −50° C., and the sheet thickness reduction ratio, in %, defined by the following formula to be 90% or more;

Sheet thickness reduction ratio ={(sheet thickness before hot rolling−sheet thickness after hot rolling)/(sheet thickness before hot rolling)}·100.

4. A process for producing the α+β titanium alloy hot-rolled sheet according to claim 2, wherein at the time of hot-rolling an α+β titanium alloy, the titanium alloy is heated to a temperature ranging from β transformation temperature to β transformation temperature +150° C., and hot-rolled uni-directionally by setting the hot rolling finishing temperature to be in a range of from β transformation temperature −250° C. to β transformation temperature −50° C., and the sheet thickness reduction ratio, in %, defined by the following formula to be 90% or more;

Sheet thickness reduction ratio ={(sheet thickness before hot rolling−sheet thickness after hot rolling)/(sheet thickness before hot rolling)}·100.

* * * * *